US009790809B2

(12) United States Patent
Dube et al.

(10) Patent No.: US 9,790,809 B2
(45) Date of Patent: Oct. 17, 2017

(54) DAMPER FOR STATOR ASSEMBLY

(71) Applicant: United Technologies Corporation, Hartford, CT (US)

(72) Inventors: David P. Dube, Saco, ME (US); Nicholas R. Leslie, South Berwick, ME (US); Randall J. Butcher, Cape Neddick, ME (US)

(73) Assignee: United Technologies Corporation, Farmington, CT (US)

( * ) Notice: Subject to any disclaimer, the term of this patent is extended or adjusted under 35 U.S.C. 154(b) by 274 days.

(21) Appl. No.: 14/666,458

(22) Filed: Mar. 24, 2015

(65) Prior Publication Data

US 2016/0281531 A1 Sep. 29, 2016

(51) Int. Cl.

| | |
|---|---|
| ***F01D 9/04*** | (2006.01) |
| ***F01D 11/12*** | (2006.01) |
| ***F01D 25/04*** | (2006.01) |
| ***F01D 5/26*** | (2006.01) |
| ***F01D 11/00*** | (2006.01) |

(52) U.S. Cl.

CPC ..... *F01D 25/04* (2013.01); *F01D 5/26* (2013.01); *F01D 9/041* (2013.01); *F01D 11/001* (2013.01); *F01D 11/122* (2013.01); *F05D 2220/32* (2013.01); *F05D 2240/12* (2013.01); *F05D 2240/55* (2013.01); *F05D 2240/80* (2013.01)

(58) Field of Classification Search

CPC ..... F01D 9/02; F01D 11/001; F01D 11/122; F01D 25/04; F05D 2220/32; F05D 2240/12; F05D 2240/55; F05D 2240/80

See application file for complete search history.

(56) References Cited

U.S. PATENT DOCUMENTS

| | | | | |
|---|---|---|---|---|
| 3,966,356 | A | 6/1976 | Irwin | |
| 4,431,373 | A | 2/1984 | Monsarrat | |
| 4,897,021 | A | 1/1990 | Chaplin et al. | |
| 5,346,362 | A * | 9/1994 | Bonner et al. | F01D 11/08 415/119 |
| 5,785,492 | A | 7/1998 | Belsom et al. | |
| 6,042,334 | A | 3/2000 | Schilling | |
| 6,547,257 | B2 * | 4/2003 | Cromer | F16J 15/3288 277/355 |

(Continued)

FOREIGN PATENT DOCUMENTS

| | | |
|---|---|---|
| EP | 1635037 A2 | 3/2006 |
| EP | 2612998 A2 | 7/2013 |
| EP | 2613021 A2 | 7/2013 |

OTHER PUBLICATIONS

Hayford, Richard K. Stator Assembly for Gas Turbine Engine. U.S. Appl. No. 62/058,389, filed Oct. 1, 2014.

(Continued)

*Primary Examiner* — Igor Kershteyn

(74) *Attorney, Agent, or Firm* — Carlson, Gaskey & Olds, P.C.

(57) ABSTRACT

A stator assembly for a gas turbine engine according to an exemplary aspect of the present disclosure includes, among other things, at least one stator vane including a platform, a seal member connected to the platform, and a damper between the platform and the seal member. The damper includes a plurality of first fingers and a plurality of second fingers, which are provided in an alternating arrangement.

18 Claims, 4 Drawing Sheets

(56) References Cited

U.S. PATENT DOCUMENTS

| | | | | |
|---|---|---|---|---|
| 6,808,364 | B2 | 10/2004 | O'Reilly et al. | |
| 7,291,946 | B2 | 11/2007 | Clouse et al. | |
| 7,837,435 | B2 | 11/2010 | Ellis et al. | |
| 8,206,094 | B2 | 6/2012 | Seki et al. | |
| 8,240,043 | B2 | 8/2012 | Duesler et al. | |
| 8,398,366 | B2 | 3/2013 | Twell | |
| 8,708,641 | B2 | 4/2014 | Ueda et al. | |
| 2005/0057003 | A1* | 3/2005 | Iguchi | F16J 15/0887 277/591 |
| 2005/0082768 | A1* | 4/2005 | Iguchi | F01D 11/005 277/591 |
| 2009/0072497 | A1* | 3/2009 | Kunitake | F01D 9/023 277/641 |
| 2009/0085305 | A1* | 4/2009 | Demiroglu | F16J 15/0887 277/637 |
| 2010/0247005 | A1* | 9/2010 | Aschenbruck | F01D 9/023 384/15 |
| 2011/0135479 | A1 | 6/2011 | Ueda et al. | |
| 2011/0140370 | A1* | 6/2011 | Sutcu | F01D 9/023 277/603 |
| 2012/0180500 | A1 | 7/2012 | DiCintio | |
| 2012/0292861 | A1* | 11/2012 | Moehrle | F01D 9/023 277/641 |
| 2013/0101395 | A1 | 4/2013 | Miller et al. | |
| 2013/0177401 | A1* | 7/2013 | Ring | F01D 25/04 415/119 |
| 2014/0225334 | A1 | 8/2014 | Kugimiya et al. | |

OTHER PUBLICATIONS

European Search Report for European Application No. 16162070.3 dated Oct. 2, 2016.

* cited by examiner

DAMPER FOR STATOR ASSEMBLY

BACKGROUND

A gas turbine engine typically includes a fan section, a compressor section, a combustor section, and a turbine section. One way to increase the efficiency of the gas turbine engine is to decrease the amount of compressor air that leaks from the compressor section. In order to reduce unwanted air leaks from the compressor section, various seals are incorporated into the compressor section.

One type of seal is a knife edge seal. Knife edge seals deter compressed air from leaking past the seal. In one known arrangement, knife edge seals project from a rotor disk toward an abradable material supported by a radially inner platform of a stator assembly. The stator assembly may include a damper configured to reduce vibrations between the knife edge seal, the abradable material, and the stator assembly.

SUMMARY

A stator assembly for a gas turbine engine according to an exemplary aspect of the present disclosure includes, among other things, at least one stator vane including a platform, a seal member connected to the platform, and a damper between the platform and the seal member. The damper includes a plurality of first fingers and a plurality of second fingers, which are provided in an alternating arrangement.

In a further non-limiting embodiment of the foregoing assembly, the damper includes a first piece supporting the first fingers, the damper includes a second piece supporting the second fingers, and the damper includes a bridge piece connected to both the first piece and the second piece.

In a further non-limiting embodiment of the foregoing assembly, the bridge piece is in direct contact with the platform.

In a further non-limiting embodiment of the foregoing assembly, the first piece includes a first finger support, the second piece includes a second finger support, the first fingers extend from the first finger support at a non-zero angle, and the second fingers extend from the second finger support at the non-zero angle.

In a further non-limiting embodiment of the foregoing assembly, the non-zero angle is within a range of about 10 to 30 degrees.

In a further non-limiting embodiment of the foregoing assembly, the first finger support and the second finger support extend in a direction substantially parallel to an engine central longitudinal axis.

In a further non-limiting embodiment of the foregoing assembly, the first and second fingers include a free end having a curvature following a radius, and the radius has an origin radially outward of the respective finger.

In a further non-limiting embodiment of the foregoing assembly, the free ends of the first and second fingers each have an apex providing a radially innermost point of the respective finger.

In a further non-limiting embodiment of the foregoing assembly, the first and second fingers each have a terminal end spaced radially outward of the apex of the respective finger.

In a further non-limiting embodiment of the foregoing assembly, the seal member supports an abradable seal material relative to a plurality of knife edge seals.

In a further non-limiting embodiment of the foregoing assembly, the damper biases the seal carrier.

A stator assembly for a gas turbine engine according to another exemplary aspect of the present disclosure includes, among other things, at least one stator vane including a platform, a seal member connected to the platform, and a damper between the platform and the seal member. The damper includes a plurality of first fingers and a plurality of second fingers. The damper further includes a first piece supporting the first fingers and a second piece supporting the second fingers. The first and second pieces are initially formed as separate structures.

In a further non-limiting embodiment of the foregoing assembly, the damper includes a bridge piece connected to both the first piece and the second piece.

In a further non-limiting embodiment of the foregoing assembly, the bridge piece is in direct contact with the platform, and wherein the plurality of first and second fingers are in direct contact with the seal member.

A damper for a stator assembly according to an exemplary aspect of the present disclosure includes, among other things, a plurality of first fingers a plurality of second fingers. The first and second fingers are provided in an alternating arrangement.

In a further non-limiting embodiment of the foregoing damper, the damper includes a first piece supporting the first fingers, a second piece supporting the second fingers, and a bridge piece connected to both the first piece and the second piece.

In a further non-limiting embodiment of the foregoing damper, the first piece includes a first finger support, the second piece includes a second finger support, and the bridge piece is connected to the first finger support and the second finger support.

In a further non-limiting embodiment of the foregoing damper, the first fingers extend from the first finger support at a non-zero angle, and the second fingers extend from the second finger support at the non-zero angle.

In a further non-limiting embodiment of the foregoing damper, the non-zero angle is within a range of about 10 to 30 degrees.

In a further non-limiting embodiment of the foregoing damper, the first finger support and the second finger support extend in a direction substantially parallel to one another.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE DRAWINGS

The drawings can be briefly described as follows.

DETAILED DESCRIPTION

Figure 1:
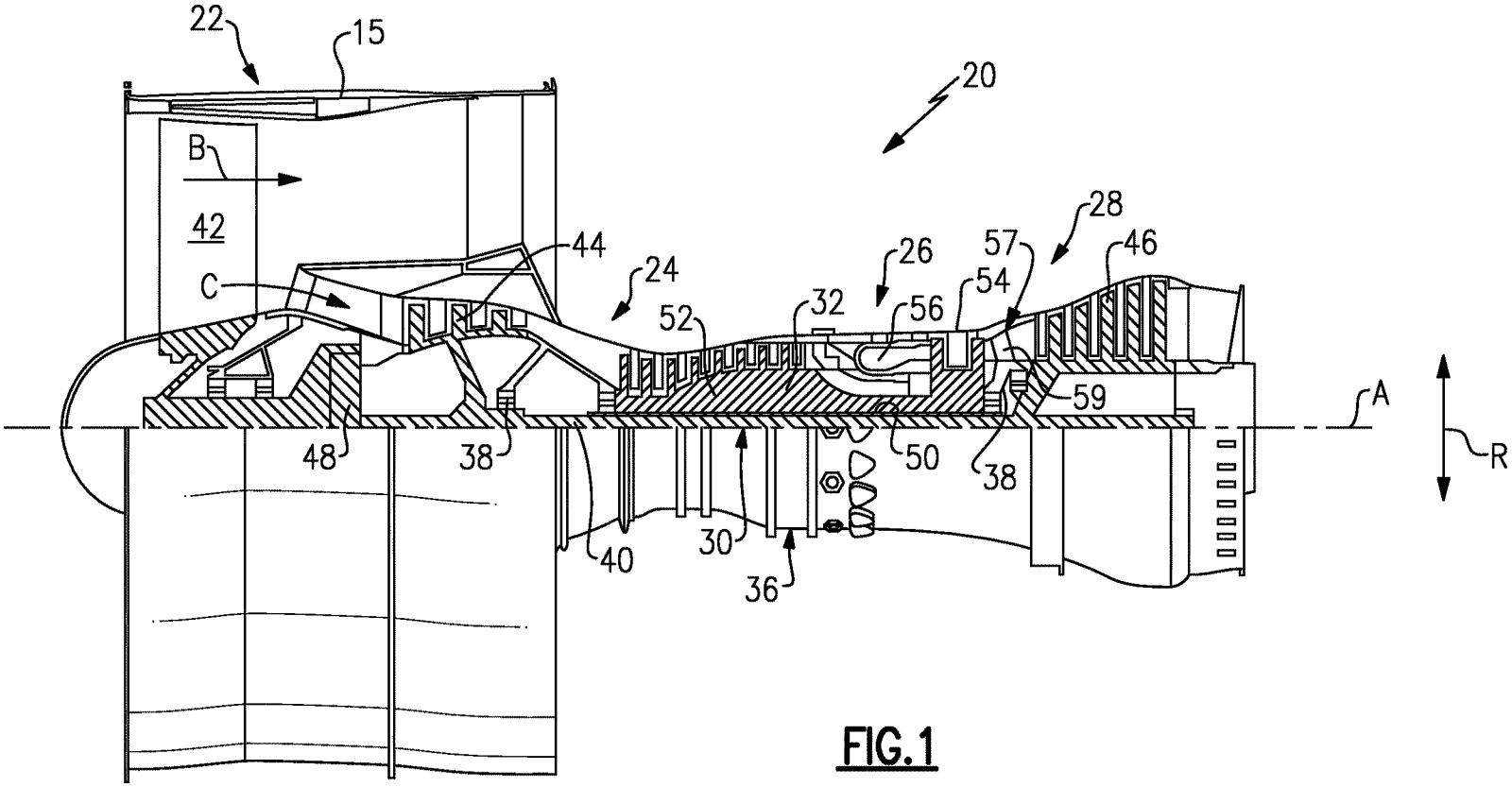
FIG. 1 is a schematic view of an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

Figure 2:
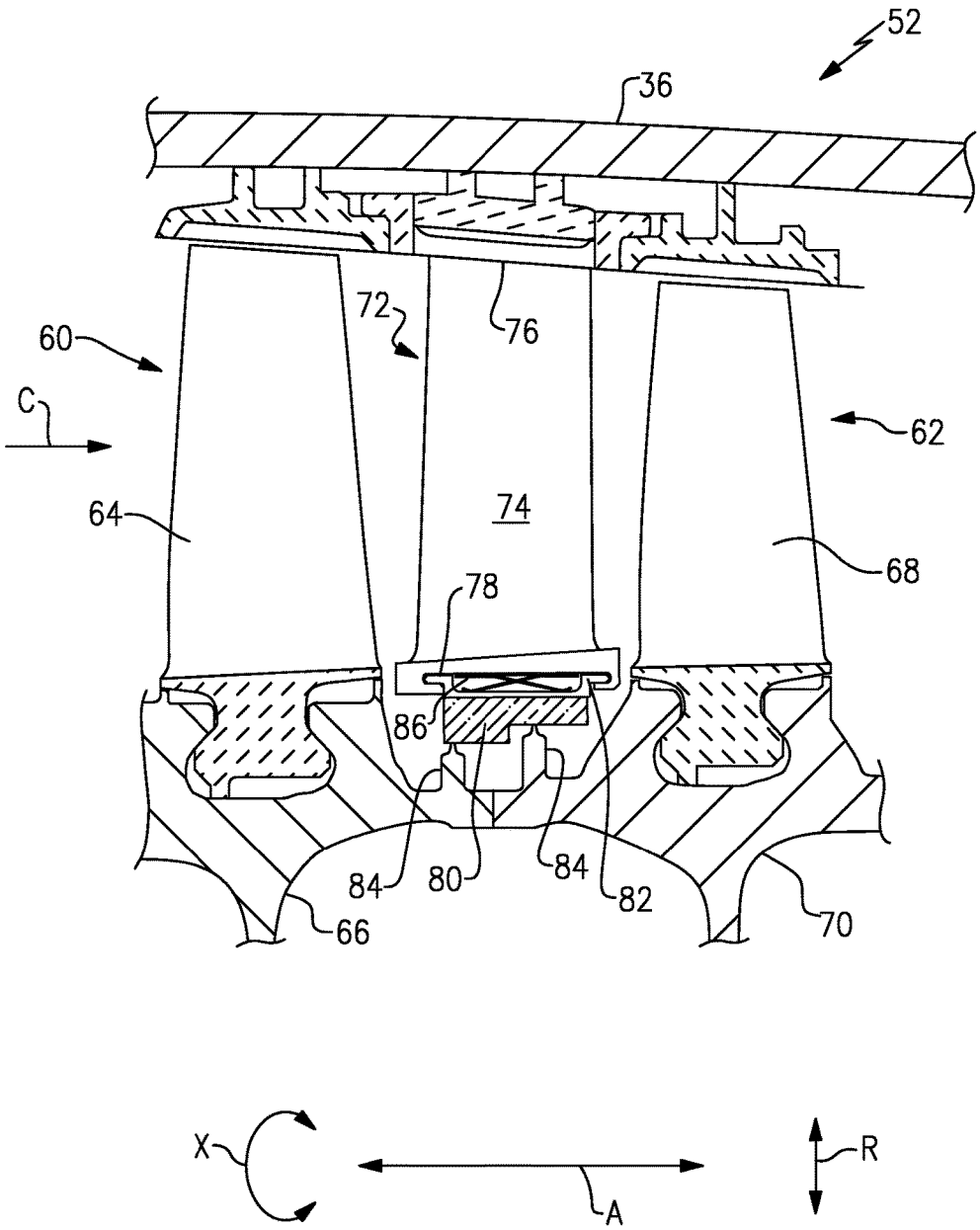
FIG. 2 is a schematic cross-section of a section for the gas turbine engine of FIG. 1.

FIG. 2 is a schematic view of a section of the gas turbine engine 20. In this example, the section is the high pressure compressor 52. It should be understood, however, that other sections of the gas turbine engine 20 could benefit from this disclosure. The high pressure compressor 52 includes multiple stages. For purposes of illustration, only a first rotor assembly 60 and a second rotor assembly 62 are shown. The first rotor assembly 60 and the second rotor assembly 62 are attached to the outer shaft 50 of FIG. 1.

The first rotor assembly 60 includes a first array of rotor blades 64 circumferentially spaced around a first disk 66, and the second rotor assembly 62 includes a second array of rotor blades 68 circumferentially spaced around a second disk 70. An array of stator vanes 72 is provided axially (relative to the engine central longitudinal axis A) between the first array of rotor blades 64 and the second array of rotor blades 68.

Each of the stator vanes 72 has an airfoil section 74 radially extending (relative to the radial direction R, which is normal to the engine central longitudinal axis A) between a radially outer platform 76 and a radially inner platform 78. In this example, a seal member is supported relative to the radially inner platform 78. The seal member includes an abradable annular seal 80, such as honeycomb seal, and a seal carrier 82. The seal carrier 82 supports the abradable annular seal 80 relative to knife edges 84 projecting radially outward from the first and second disks 66, 70.

A damper 86 is provided between the radially inner platform 78 and the seal carrier 82. The damper 86 provides a continuous ring about the engine central longitudinal axis A or, alternatively, a plurality of segmented dampers 86 may circumferentially abut one another to form a segmented ring. For purposes of clarity, an enlarged view of an example damper 86 is shown in FIG. 3.

Figure 3:
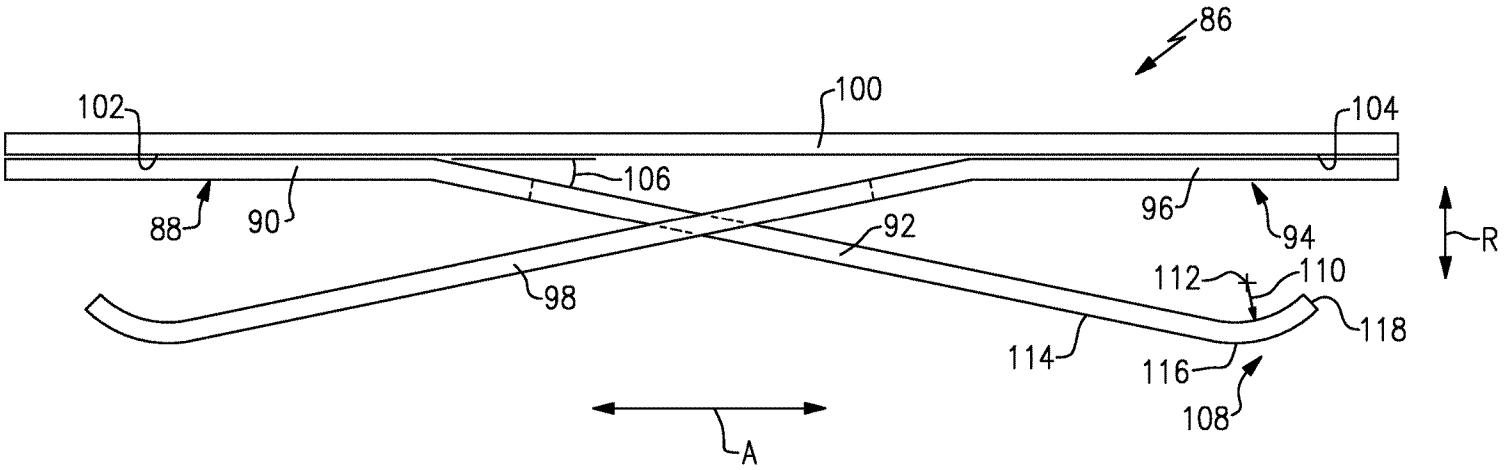
FIG. 3 is a side view of the damper of FIG. 2.
Figure 4:
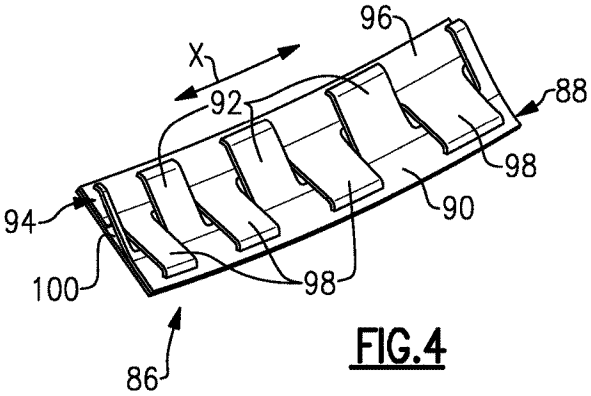
FIG. 4 is an inner perspective view of the damper of FIG. 2.

With reference to FIG. 3, the damper 86 includes a first piece 88 having a first finger support 90 and a first plurality of fingers 92. As best seen in FIG. 4, the first fingers 92 are spaced-apart from one another relative to a circumferential direction X (i.e., about the engine central longitudinal axis A). The damper 86 also includes a second piece 94 having a second finger support 96 and a second plurality of fingers 98. As shown in FIG. 4, the damper 86 is arranged such that the first and second fingers 92, 98 are provided in an alternating arrangement. That is, moving in the circumferential direction X, one of the first fingers 92 is provided in the circumferential space between adjacent second fingers 98, and vice versa.

The damper 86 further includes a third, bridge piece 100 connecting the first piece 88 and the second piece 94. As shown, the first finger support 90 is connected to a first axial end (e.g., the left-hand side of FIG. 3) of the bridge piece 100, and the second finger support 96 is connected to the bridge piece 100 at an opposite, second axial end (e.g., the right-hand side of FIG. 3). In one example, welds are provided at locations 102, 104 radially between the first finger support 90 and the bridge piece 100, and the second finger support 96 and the bridge piece 100, respectively. In another example, the bridge piece 100 is brazed to the first and second pieces 88, 94. In yet another example, the bridge piece 100 could be fastened to the first and second pieces 88, 94 using any known type of mechanical fastener.

The fingers 92, 98 are shaped to provide a reliable engagement with the seal carrier 82. The shape of the fingers will now be described with reference to one of the first fingers 92. As shown in FIG. 3, the finger 92 projects from the first finger support 90 toward an axially opposite side of the damper 86 (e.g., from left-to-right relative to FIG. 3) at a non-zero angle 106 relative to the first finger support 90. In one example, the angle 106 is within a range of about 10 to 30 degrees. Further, in this example, the first finger support 90 extends in a direction substantially parallel to the engine central longitudinal axis A.

With continued reference to FIG. 3, the finger 92 projects from the first finger support 90 and terminates at a free end 108. The free end 108 in this example is axially aligned (in the direction of the engine central longitudinal axis A) with the second finger support 94 and is radially spaced-apart (in the radial direction R) therefrom. The free end 108 has a curvature following a radius 110 having an origin 112 radially outward of the finger 92.

The radius 110 is selected to provide the damper 86 with a relatively low profile. That is, the radius 110 provides the damper 86 with a relatively small height dimension (i.e., the dimension in the radial direction R) to allow the damper to fit into slots having small radial dimensions. The curvature of the free end 108 is such that the radially inner surface 114 of the finger 92 has an apex 116 that provides the radially innermost point of the finger 92. The terminal end 118 of the finger 92 is radially outward of the apex 116.

In this example, the first piece 88 is made of a single, continuous piece of metallic material. The fingers 92 are shaped using a bending process. Likewise, the second piece 94 is made of a single, continuous piece of metallic material, and the fingers 98 are shaped by a bending process. The third piece 100 is also made of a single, continuous piece of metallic material that is separate from the pieces providing the first and second pieces 88, 94. The first, second, and third pieces 88, 94, 100 are initially formed as separate structures and then connected together in this example. While the damper 86 includes multiple components, the damper 86 is relatively easy to manufacture because there is a minimal amount of bending required to make the fingers 92, 98.

Figure 5:
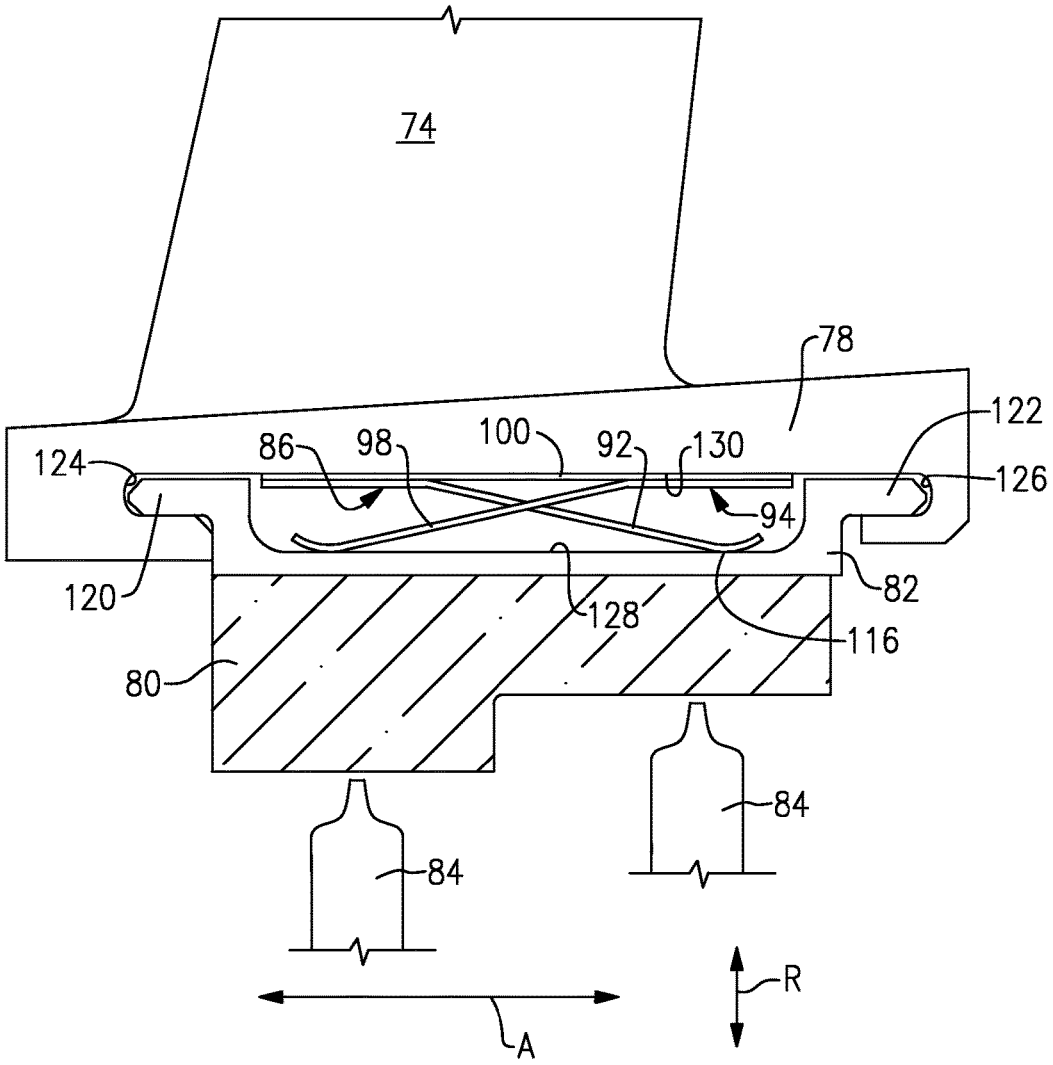
FIG. 5 is an enlarged view of a vane platform of FIG. 2.

FIG. 5 shows the detail of the arrangement of the damper 86 relative to the radially inner platform 78 and the seal carrier 82. In this example, the seal carrier 82 includes fore and aft engagement tabs 120, 122 received in respective fore and aft engagement slots 124, 126 formed in the radially inner platform 78. The damper 86 is provided axially between the fore and aft engagement tabs 120, 122, and is provided radially between a radially outer surface 128 of the seal carrier 82 and a radially inner surface 130 of the radially inner platform 78.

The bridge piece 100 of the damper 86 is in direct contact with the radially inner surface 130 of the radially inner platform 78. The apexes (e.g., the apex 116) of the first fingers 92 and the second fingers 98 are in direct contact with the radially outer surface 128 of the seal carrier 82. As shown, the first fingers 92 contact the radially outer surface 128 at an aft location, and the second fingers 98 contact the radially outer surface at a fore location. The distance between the contact points provides a stable, reliable connection.

After being formed (e.g., being bent into position), the first and second fingers 92, 98 take on a "relaxed" position. Without any outside forces, the first and second fingers 92, 98 would remain in the relaxed position. When engaged with the radially outer surface 128 of the seal carrier 82, however, the fingers 92, 98 are urged radially outward relative to the relaxed position. The resiliency of the material of the fingers 92, 98 results in a biasing force being exerted by the damper 86 in a radially inward direction on the seal carrier 82.

The damper 86 provides increased contact between the abradable annular seal 80 and the knife edges 84. The damper 86 thus allows for increased and more reliable sealing. Additionally, because of the axial spacing between the apexes of the fingers 92, 98, the force exerted on the seal carrier 82 is relatively uniform along the axial direction. This leads to a reduction in seal wear rate relative to dampers that provide a more centrally-located biasing force.

Again, it should be understood that terms such as "fore," "aft," "axial," "radial," and "circumferential" are used above with reference to the orientation of the objects in the figures, and with reference to the normal operational attitude of the engine 20. Further, these terms have been used herein for purposes of explanation, and should not be considered otherwise limiting. Terms such as "generally," "substantially," and "about" are not intended to be boundaryless terms, and should be interpreted consistent with the way one skilled in the art would interpret the term.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A stator assembly for a gas turbine engine, comprising:
at least one stator vane including a platform;
a seal member connected to the platform; and
a damper between the platform and the seal member, the damper including a plurality of first fingers and a plurality of second fingers, the first and second fingers provided in an alternating arrangement, wherein the damper includes a first piece supporting the first fingers, the damper includes a second piece supporting the second fingers, and the damper includes a bridge piece connected to both the first piece and the second piece.

2. The assembly as recited in claim 1, wherein the bridge piece is in direct contact with the platform.

3. The assembly as recited in claim 1, wherein:
the first piece includes a first finger support;
the second piece includes a second finger support;
the first fingers extend from the first finger support at a non-zero angle; and
the second fingers extend from the second finger support at the non-zero angle.

4. The assembly as recited in claim 3, wherein the non-zero angle is within a range of about 10 to 30 degrees.

5. The assembly as recited in claim 3, wherein the first finger support and the second finger support extend in a direction substantially parallel to an engine central longitudinal axis.

6. The assembly as recited in claim 1, wherein the first and second fingers include a free end having a curvature following a radius, the radius having an origin radially outward of the respective finger.

7. The assembly as recited in claim 6, wherein the free ends of the first and second fingers each have an apex providing a radially innermost point of the respective finger.

8. The assembly as recited in claim 7, wherein the first and second fingers each have a terminal end spaced radially outward of the apex of the respective finger.

9. The assembly as recited in claim 1, wherein the seal member supports an abradable seal material relative to a plurality of knife edge seals.

10. The assembly as recited in claim 9, wherein the damper biases the seal carrier.

11. A stator assembly for a gas turbine engine, comprising:

at least one stator vane including a platform;

a seal member connected to the platform; and a damper between the platform and the seal member, the damper including a plurality of first fingers and a plurality of second fingers, the damper further including a first piece supporting the first fingers and a second piece supporting the second fingers, wherein the first and second pieces are initially formed as separate structures.

12. The assembly as recited in claim 11, wherein the damper includes a bridge piece connected to both the first piece and the second piece.

13. The assembly as recited in claim 12, wherein the bridge piece is in direct contact with the platform, and wherein the plurality of first and second fingers are in direct contact with the seal member.

14. A damper for a stator assembly, comprising:

a plurality of first fingers;

a plurality of second fingers, the first and second fingers provided in an alternating arrangement;

a first piece supporting the first fingers;

a second piece supporting the second fingers; and a bridge piece connected to both the first piece and the second piece.

15. The damper as recited in claim 14, wherein:

the first piece includes a first finger support;

the second piece includes a second finger support; and the bridge piece is connected to the first finger support and the second finger support.

16. The damper as recited in claim 15, wherein:

the first fingers extend from the first finger support at a non-zero angle; and the second fingers extend from the second finger support at the non-zero angle.

17. The damper as recited in claim 16, wherein the non-zero angle is within a range of about 10 to 30 degrees.

18. The damper as recited in claim 16, wherein the first finger support and the second finger support extend in a direction substantially parallel to one another.

* * * * *